US006334469B1

(12) United States Patent
Taniguchi

(10) Patent No.: US 6,334,469 B1
(45) Date of Patent: Jan. 1, 2002

(54) RECHARGING CONNECTOR FOR PORTABLE LP (LIQUEFIED PETROLEUM) GAS CYLINDERS

(75) Inventor: Hitoshi Taniguchi, Tokyo (JP)

(73) Assignee: Iwatani International Corporation (JP)

( * ) Notice: Subject to any disclaimer, the term of this patent is extended or adjusted under 35 U.S.C. 154(b) by 0 days.

(21) Appl. No.: 09/508,075

(22) PCT Filed: Aug. 25, 1999

(86) PCT No.: PCT/JP99/04601

§ 371 Date: Mar. 13, 2000

§ 102(e) Date: Mar. 13, 2000

(87) PCT Pub. No.: WO00/40890

PCT Pub. Date: Jul. 13, 2000

(30) Foreign Application Priority Data

Jan. 8, 1999 (JP) ..... 11-2659

(51) Int. Cl.[7] ..... F17C 5/02
(52) U.S. Cl. ..... 141/18; 141/383
(58) Field of Search ..... 141/2, 3, 18, 21, 141/383, 384, 386

(56) References Cited

U.S. PATENT DOCUMENTS 2,680,546 A * 6/1954 Seaberg ..... 141/384
4,640,323 A * 2/1987 Norcia et al. ..... 141/18
4,667,708 A * 5/1987 Jernberg ..... 141/1
4,999,140 A * 3/1991 Sutherland et al. ..... 141/18
5,027,871 A * 7/1991 Guenther ..... 141/18
5,037,063 A * 8/1991 Kerger et al. ..... 141/18
5,150,741 A * 9/1992 Valy et al. ..... 141/18
5,309,945 A * 5/1994 Sakai et al. ..... 141/18
5,487,404 A * 1/1996 Kerger ..... 141/18
5,676,186 A * 10/1997 Vanderploeg ..... 141/18
6,003,547 A * 12/1999 Tippmann, Jr. ..... 141/3

FOREIGN PATENT DOCUMENTS

JP 7-22200 * 4/1995 ..... F17C/5/00

* cited by examiner

*Primary Examiner*—J. Casimer Jacyna
(74) *Attorney, Agent, or Firm*—Bacon & Thomas, PLLC

(57) ABSTRACT

A connector (1) is provided between both portable LP gas storing cylinders when transferring and charging LP gas from this to that. One retainer (6) for a supplying LP gas cylinder (2) is positioned on an upper surface of a connector main body (5) which houses a flow passage opening and closing valve (4). The other retainer (7) for a receiving LP gas cylinder (3) is arranged on a lower surface of the connector main body (5). The upper surface of the connector main body (5) is opened at a mid portion of the one retainer (6) to provide an LP gas receiving inlet (14), which communicates with an LP gas taking outlet (23) provided by opening the lower surface of the connector main body (5) at a mid portion of the other retainer (7) through the flow passage opening and closing valve (4).

1 Claim, 3 Drawing Sheets

RECHARGING CONNECTOR FOR PORTABLE LP (LIQUEFIED PETROLEUM) GAS CYLINDERS

TECHNICAL FIELD

The present invention relates to a connector which is used when charging LP gas into an LP gas storing cylinder to be employed for a fuel source of a portable gas burner instrument and more particularly to an LP gas recharging connector which makes it possible to recharge the LP gas easily in a house.

Earlier Technology

There is a conventional LP gas storing cylinder which is used for a portable gas burner instrument. This conventional cylinder comprises a main body having a top portion to which a gas take-out nozzle constituting part of a gas shut-off valve is attached so as to be able to advance and retreat. When the LP gas storing cylinder is attached to the gas burner instrument, the gas take-out nozzle is pushed into the cylinder to open the gas shut-off valve. Conversely, when it is removed from the gas burner instrument, the gas take-out nozzle advances to close the gas shut-off valve.

Generally, the gas storing cylinder of this type is charged with LP gas in a factory and thereafter is circulated in the market. The gas shut-off valve is formed from one gas passage. Therefore, a trial to recharge the LP gas has resulted in vain unless the charging gas is pressurized by a compressor or a receiving gas storing cylinder is cooled to have a low temperature so as to reduce its inner pressure because gas residual in the cylinder is pressurized to resist pouring as soon as the LP gas recharging begins. For this reason, the LP gas could not be recharged in an ordinary house. Therefore, the LP gas cylinder was generally disposed after the gas contained therein had been used and could be employed only once.

However, the disposed gas storing cylinder still keeps so sufficient a strength that it costs a huge amount of expense to deal with the disposed gas storing cylinders. Therefore, economical loss resulted from disposing the gas storing cylinders still usable as well as from dealing with the disposed gas storing cylinders.

Thus the present Applicant previously proposed a portable gas storing cylinder able to be easily recharged with the LP gas (patent application Ser. No. 10-313089). Attached to a top portion of this gas storing cylinder is a valve unit including a gas take-out nozzle and a guide pipe. When recharging the LP gas, gaseous component within the cylinder is adapted to be taken out.

The previously proposed portable gas storing cylinder has a disadvantage that a supplying portable gas cylinder must have a nozzle directly connected to a nozzle of a receiving portable gas cylinder and maintain the connecting position for a long time.

In an attempt to solve the above disadvantage, the present invention aims at providing a connector for LP gas storing cylinders, able to easily retain the supplying portable gas cylinder connected to the receiving portable gas cylinder at a predetermined position when recharging the LP gas in a house.

DISCLOSURE OF THE INVENTION

The present invention is characterized by positioning one retainer for a supplying LP gas cylinder on an upper surface of a connector main body which houses a flow passage opening and closing valve, and arranging the other retainer for a receiving LP gas cylinder on a lower surface of the connector main body, an LP gas receiving inlet provided by opening the upper surface of the connector main body at a mid portion of the one retainer communicating with an LP gas taking outlet provided by opening the lower surface of the connector main body at a mid portion of the other retainer through the flow passage opening and closing valve.

The present invention positions the one retainer for the supplying LP gas cylinder on the upper surface of the connector main body which houses the flow passage opening and closing valve and arranges the other retainer for the receiving LP gas cylinder on the lower surface of the connector main body, the LP gas receiving inlet provided by opening the upper surface of the connector main body at the mid portion of the one retainer communicating with the LP gas taking outlet provided by opening the lower surface of the connector main body at the mid portion of the other retainer through the flow passage opening and closing valve. Thus when the receiving LP gas cylinder and the supplying LP gas cylinder are supported by the lower surface and the upper surface of the connector main body, respectively, gas shut-off valves of the respective cylinders are opened to connect the supplying LP gas cylinder to the receiving LP gas cylinder through communication passages formed in the connector main body, thereby enabling the LP gas contained in the supplying LP gas cylinder to flow down into the receiving LP gas cylinder. At this time, gas residual in the receiving LP gas cylinder is taken out of the cylinder through a guide pipe formed in a valve unit of the receiving LP gas cylinder to thereby smoothly flow down the LP gas within the supplying LP gas cylinder into the receiving LP gas cylinder.

MOST PREFERRED EMBODIMENT OF THE INVENTION

Figure 1:
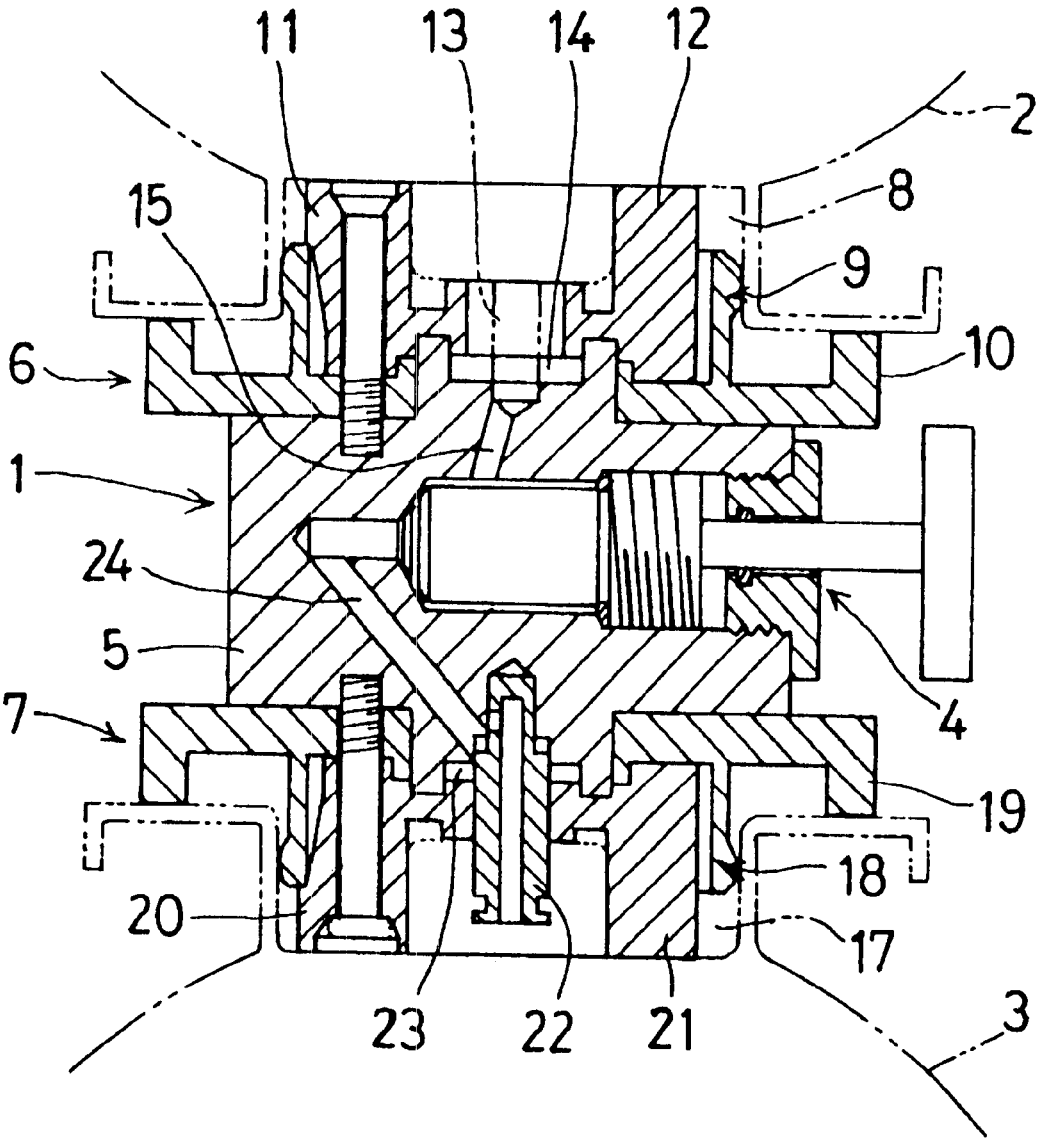
FIG. 1 shows an embodiment of the present invention and is a decomposed perspective view illustrating a state where LP gas is transferred and charged from a first cylinder to a second cylinder.
Figure 2:
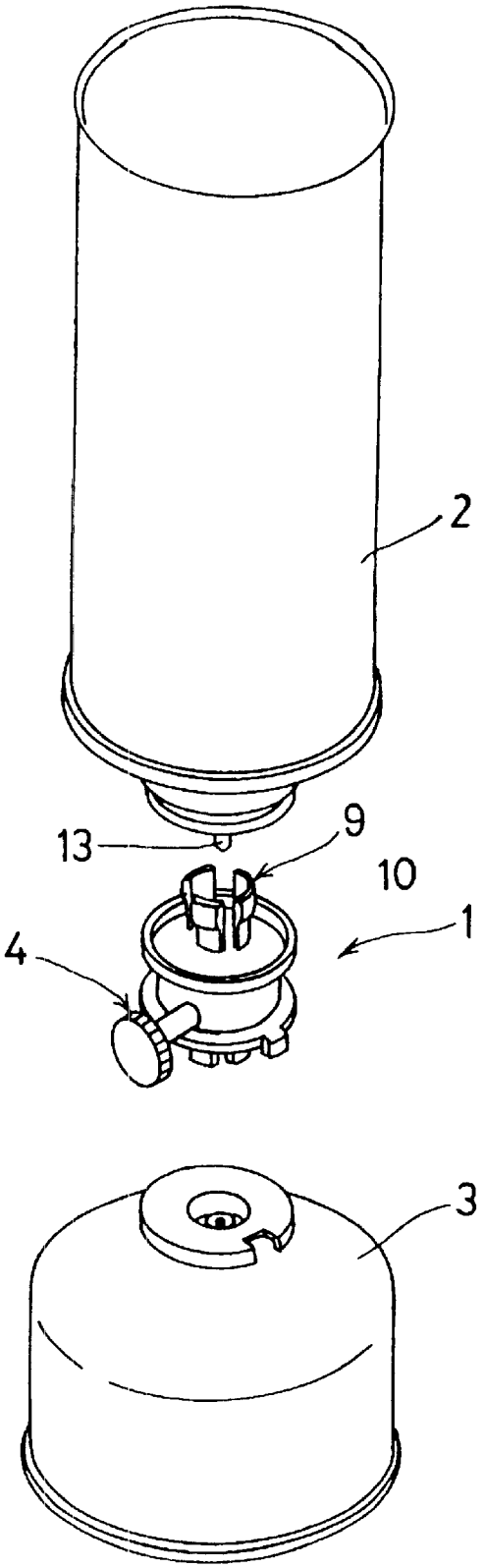
FIG. 2 is a vertical sectional view of a connector.

In the drawings numeral 1 indicates a connector. A gas cartridge (LP gas storing cylinder) to be used in a house or the like is deemed as a supplying LP gas cylinder 2 and a gas cylinder (LP gas storing cylinder) of a small volume constructed so as to be rechargeable is regarded as a receiving LP gas cylinder 3. The connector 1 has an upper surface engaged with and fixed to the supplying LP gas cylinder 2 and has a lower surface engaged with and fixed to the receiving LP gas cylinder 3.

The connector 1 comprises a main body 5 housing a flow passage opening and closing valve 4, one retainer 6 for the supplying LP gas cylinder 2 positioned on the upper surface of the main body 5 and the other retainer 7 for the receiving LP gas cylinder 3 arranged on the lower surface of the main body 5.

The one retainer 6 for the supplying LP gas cylinder 2 comprises a stopper 10 having a resilient engaging piece 9 which is fitted into a recess 8 formed in an outer periphery of a nozzle of the supplying LP gas cylinder 2 so that it is brought into contact with an inner side of the recess 8, and a fixed block 12 having a cam portion 11 positioned inside the resilient engaging piece 9 so as to push the resilient engaging piece 9 outwards. The stopper 10 is adapted so as to be rotatable within a predetermined range of angle with respect to the fixed block 12 and the connector main body 5. Further, the one retainer 6 on the upper surface of the connector main body 5 has a mid portion provided with an LP gas receiving inlet 14 for receiving a valve nozzle 13 of the supplying LP gas cylinder 2. The receiving inlet 14 communicates with a chamber for the flow passage opening and closing valve 4 through a communication passage 15.

The other retainer 7 for the receiving LP gas cylinder 3 comprises a stopper 19 having a resilient engaging piece 18 which is fitted into a recess 17 formed in an outer periphery of a nozzle of the receiving LP gas cylinder 3 so that it is brought into contact with an inner side of the recess 17, and a fixed block 21 having a cam portion 20 arranged inside the resilient engaging piece 18 so as to push the resilient engaging piece 18 outwards. The stopper 19 is adapted so as to be rotatable within a predetermined range of angle with respect to the fixed block 21 and the connector main body 5. The receiving LP gas cylinder 3 has an upper wall portion incorporating a gas shut-off valve thereinto. The other retainer 7 on the lower surface of the connector main body 5 has a mid portion provided with an LP gas taking outlet 23. Attached to this outlet 23 is a nozzle pin 22 acting on the gas shut-off valve to push it open. Further, this gas taking outlet 23 communicates with the chamber for the flow passage opening and closing valve 4 through a communication passage 24.

The supplying LP gas cylinder 2 is fixedly connected to the one retainer 6 positioned on the upper surface of the connector main body 5 in an inverted position. And the receiving LP gas cylinder 3 is fixedly connected to the other retainer 7 arranged on the lower surface of the connector main body 5 in an upright position. Then the gas shut-off valve incorporated into the upper wall portion of the supplying LP gas cylinder 2 is opened as well as the gas shut-off valve incorporated into the upper wall portion of the receiving LP gas cylinder.

Thereafter, when the flow passage opening and closing valve 4 is opened, the LP gas receiving inlet 14 communicates with the LP gas taking outlet 23 to flow down the LP gas within the supplying LP gas cylinder into the receiving LP gas cylinder 3.

When the LP gas is transferred from the supplying LP gas cylinder 2 to the receiving LP gas cylinder 3, gas residual in the receiving LP gas cylinder 3 is apt to be compressed as well as gaseous component of the flowed-in LP gas. However, attached to the receiving LP gas cylinder 3 utilized in the present invention being the gas shut-off valve provided with a degassing mechanism (guide pipe), as the LP gas flows down, gaseous component within the receiving LP gas cylinder 3 is taken out to result in smoothly flowing down the liquefied gas.

Figure 3:
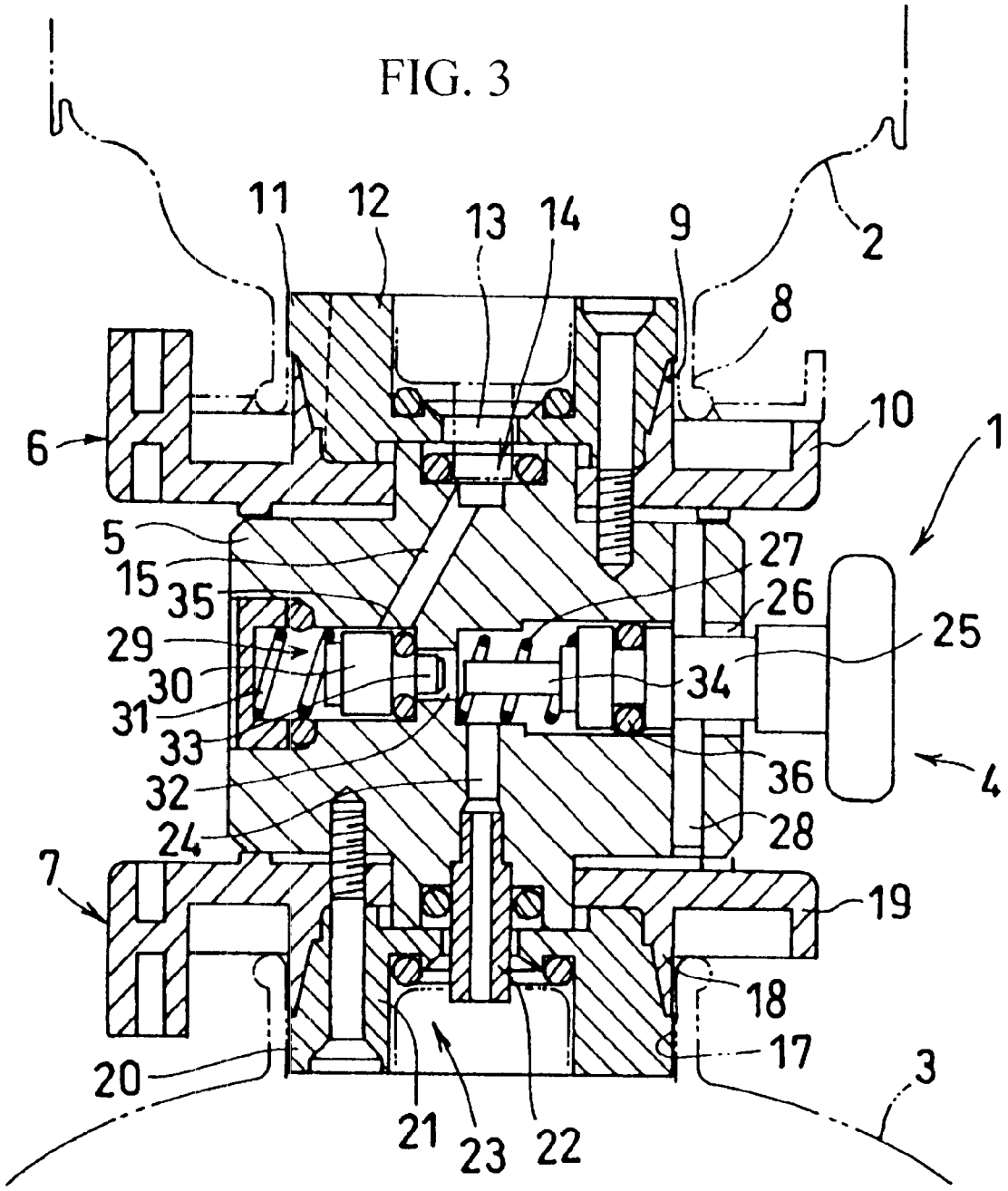
FIG. 3 is a vertical sectional view showing another embodiment of the connector.

FIG. 3 shows another embodiment of the connector 1. This embodiment adapts the flow passage opening and closing valve attached to the connector main body to that of automatically return type which is opened only while it is being operated by an actuator and is closed by removing fingers from the actuator.

More specifically, the connector main body 5 has one peripheral surface concaved to provide a hole 26 for inserting a valve actuator 25, which houses a compression coil spring at its inner end. This compression coil spring 27 resiliently urges the valve actuator in such a direction that it projects from the connector main body 5. In this case, the projecting force of the compression coil spring 27 acting on the valve actuator 25 is adjusted to be received by a removal stopper 28 vertically extending through one side end within the hole 26.

On the other hand, the connector main body 5 has the other peripheral surface concaved to provide a hole 29 for inserting a valve member 30 so as to communicate with the inner end of the valve actuator insertion hole 26. The valve member 30 is attached to the hole 29 and is resiliently urged in such a direction that it projects toward an inner side, namely in a direction for valve closing, by an urging spring 31 for valve closing formed from a compression coil spring. The valve actuator insertion hole 26 communicates with the valve member insertion hole 29 through a communication passage 32, and an end surface portion for connecting the hole 29 to the communication passage 32 is formed as a valve seat.

The valve member 30 has a projecting front end portion provided with a receiving member 33 which protrudes into the communication passage 32. The valve actuator 25 has a projecting front end portion provided with a valve member pushing portion 34 which is formed in correspondence to the communication passage 32. Consequently, when the valve actuator 25 is pushed in against a resilient force of the compression coil spring 27, the valve member pushing portion 34 formed on the front end of the valve actuator 25 protrudes into the communication passage 32 to butt against the receiving member 33 and push it in.

The communication passage 15 connected to the LP gas receiving inlet 14 of the one retainer 6 for the supplying LP gas cylinder 2 communicates with the valve member insertion hole 29 and the communication passage 24 connected to the LP gas taking outlet 23 of the other retainer for the receiving LP gas cylinder 3 communicates with the valve actuator insertion hole 26, respectively. In this Figure numeral 35 indicates an O-ring attached to the front end portion of the valve member 30 and numeral 36 designates another O-ring attached to the valve actuator 25.

When the valve actuator 25 is pushed in against the spring force of the compression coil spring 27, the pushing portion 34 pushes in the valve member 30 to open it against the urging spring 31, which results in communicating the valve member insertion hole 29 with the valve actuator insertion hole 26 through the communication passage 32. Thus the LP gas receiving inlet 14 formed in the upper surface of the connector main body 5 comes to communicate with the LP gas taking outlet 23 formed in the lower surface of the connector main body 5. In this case, since the valve member 30 is always urged in a direction for valve closing by the urging spring 31, if the valve actuator 25 loses its pushing force in the event that an operator leaves the spot or the like while transferring and charging the LP gas, the valve member 30 moves in the direction for valve closing to shut off the communication between the LP gas receiving inlet 14 and the LP gas taking outlet 23. As a result, on transferring and charging the LP gas, the operator cannot leave the spot, which can prevent the overcharging.

The receiving LP gas cylinder 3 is usable to keep foods and beverages hot in the Viking style food service which conventionally employed an alcohol lamp or a portable fuel in hotels, Japanese inns and banquet rooms as well as to provide a small fire source for foods and beverages served per person. And employable as the supplying LP gas storing cylinder is an LP gas storing cylinder generally used for a gas cooking stove of such a type as accommodating a gas cylinder, or the like.

The present invention positions one retainer for a supplying LP gas cylinder on an upper surface of a connector main body which houses a flow passage opening and closing valve and arranges the other retainer for a receiving LP gas cylinder on a lower surface of the connector main body. The connector main body has the upper surface opened at a mid portion of the one retainer to provide an LP gas receiving inlet, which communicates with an LP gas taking outlet provided by opening the lower surface of the connector main body at a mid portion of the other retainer through the flow passage opening and closing valve. Therefore, when the receiving LP gas cylinder and the supplying LP gas cylinder are supported by the lower surface and the upper surface of the connector main body, respectively, shut-off valves of the respective cylinders are opened to result in connecting the supplying LP gas cylinder to the receiving LP gas cylinder through communication passages formed in the connector main body, thereby enabling the LP gas within the supplying LP gas cylinder to flow down into the receiving gas cylinder owing to differential pressure and gravity. At this time, gas residual in the receiving LP gas cylinder is taken out of the cylinder through a guide pipe formed in a valve unit of the receiving LP gas cylinder to thereby smoothly flow down the LP gas within the supplying LP gas cylinder into the receiving LP gas cylinder.

What is claimed is:

1. A recharging connector having a main body with two ends for transferring LP gas between a pair of portable LP gas cylinders each having a shut-off valve for preventing passage of gas, said recharging connector adapted to accommodate an LP gas cylinder at each end and open a shut-off valve of an LP gas cylinder when mounted at one end thereon, wherein one retainer (6) for a supplying LP gas cylinder (2) is positioned on an upper surface of said connector main body (5) which houses a flow passage and a flow passage opening and closing valve (4) and another retainer (7) for a receiving LP gas cylinder (3) is arranged on a lower surface of said connector main body (5), said recharging connector arranged to connect the retainers generally along the same axis, the upper surface of the connector main body (5) being opened at a mid portion of the one retainer (6) to provide an LP gas receiving inlet (14), which communicates with an LP gas taking outlet (23) provided by opening the lower surface of the connector main body (5) at a mid portion of the other retainer (7) through the flow passage opening and closing valve (4).

* * * * *